US009511558B1

(12) United States Patent
Colombo et al.

(10) Patent No.: US 9,511,558 B1
(45) Date of Patent: Dec. 6, 2016

(54) METHOD FOR COLLECTING AND REMOVING REFUSE FROM AN UNDERGROUND MINE

(75) Inventors: Mark Colombo, Marion, IL (US); David Lockwood, Pittsburg, IL (US); Darrell Ross, Marion, IL (US)

(73) Assignee: UNDERGROUND COMPACTORS, INC., Marion, IL (US)

( * ) Notice: Subject to any disclaimer, the term of this patent is extended or adjusted under 35 U.S.C. 154(b) by 459 days.

(21) Appl. No.: 13/506,579

(22) Filed: Apr. 30, 2012

(51) Int. Cl.

| | |
|---|---|
| ***B30B 13/00*** | (2006.01) |
| ***B65F 9/00*** | (2006.01) |
| ***B65F 1/14*** | (2006.01) |
| ***B30B 12/00*** | (2006.01) |
| ***B30B 9/30*** | (2006.01) |

(52) U.S. Cl.
CPC ..... *B30B 13/00* (2013.01); *B30B 9/3046* (2013.01); *B30B 12/00* (2013.01); *B65F 1/1447* (2013.01); *B65F 9/00* (2013.01); *B65F 2210/162* (2013.01)

(58) Field of Classification Search
CPC ..... B65F 9/00; B65F 1/1447; B65F 2210/162; B09B 5/00; Y02W 30/10; B30B 13/00; B30B 12/00; B30B 9/3046; B30B 9/3057; B30B 9/3072
USPC ..... 100/35, 102, 240, 245, 299
See application file for complete search history.

(56) References Cited

U.S. PATENT DOCUMENTS

| | | | | |
|---|---|---|---|---|
| 2,782,710 | A * | 2/1957 | Fishburne | 100/100 |
| 3,318,231 | A * | 5/1967 | Felts | 100/52 |
| 3,881,407 | A | 5/1975 | Goar | |
| 4,144,806 | A | 3/1979 | Broussard | |
| 4,269,562 | A | 5/1981 | Burgess | |
| 4,358,238 | A | 11/1982 | Ely | |
| 4,656,937 | A * | 4/1987 | Turner, Jr. | 100/100 |
| 5,341,731 | A * | 8/1994 | Grizzard et al. | 100/100 |
| 5,348,125 | A * | 9/1994 | Stribling | 191/12.2 R |
| 5,579,684 | A * | 12/1996 | Stribling | 100/48 |
| 5,826,808 | A * | 10/1998 | Giovanardi | 241/27 |
| 6,305,278 | B1 * | 10/2001 | Freeberg | 100/100 |
| 6,550,378 | B1 | 4/2003 | Wales, Jr. | |

(Continued)

FOREIGN PATENT DOCUMENTS

| | | |
|---|---|---|
| DE | 42 40 286 | 6/1994 |

OTHER PUBLICATIONS

Machine translation for German 42 40 286 listed in IDS (Feb. 13, 2013).*

*Primary Examiner* — Jimmy T Nguyen
(74) *Attorney, Agent, or Firm* — Price & Adams, P.C.

(57) ABSTRACT

A compaction device is removably connected to a refuse receiver and is positioned on a skid mounted frame which is dragged by a utility vehicle through an underground mine for the collection of waste material collected from the mining operations. The waste material is deposited into a compaction chamber and compacted in the receiver. Where electric power is not accessible for operation of the compaction device, hydraulic power is supplied from the hydraulic power takeoff on the utility vehicle. The receiver filled with compacted waste material is disconnected from the compaction device and lifted from the support frame onto the utility vehicle. The receiver is transported out of the mine for pick-up of the compacted waste material by a commercial waste hauler. By collecting and compacting waste material in the mine, the frequency of hauls of waste material from the mine and the associated costs are substantially reduced.

15 Claims, 5 Drawing Sheets

(56) References Cited

U.S. PATENT DOCUMENTS

| | | | | |
|---|---|---|---|---|
| 7,000,532 | B2 * | 2/2006 | Imperato | 100/52 |
| 7,597,045 | B2 | 10/2009 | Sargent | |
| 7,886,660 | B1 * | 2/2011 | Sherwood et al. | 100/229 A |
| 7,980,173 | B2 | 7/2011 | Carmack et al. | |
| 2008/0314263 | A1 * | 12/2008 | Martin | 100/102 |
| 2009/0133730 | A1 * | 5/2009 | McVey | 135/93 |
| 2009/0145312 | A1 * | 6/2009 | Allen | 100/229 R |
| 2010/0064910 | A1 * | 3/2010 | Carmack et al. | 100/240 |
| 2011/0000382 | A1 * | 1/2011 | Sherwood et al. | 100/35 |

* cited by examiner

METHOD FOR COLLECTING AND REMOVING REFUSE FROM AN UNDERGROUND MINE

BACKGROUND OF THE INVENTION

1. Field of the Invention

The present invention relates to the collection and removal of refuse from an underground mine and more particularly to a mobile compactor unit that is transported to selected locations in the mine where refuse is collected and compacted and the compacted refuse is transported to a location where it is extracted from the mine to the surface for disposal out of the mine.

2. Description of the Prior Art

Modern advances in underground mining operations have demanded an increase in the use of materials and supplies which has created the generation of a substantial amount of refuse and waste materials that require disposal. The necessity of disposal of the waste material is mandated to comply with mine safety regulations which are strictly enforced, particularly to address the need for fire prevention which can have catastrophic results to personnel and equipment in an underground mine.

The refuse, waste material, and debris that are generated in conducting underground mining operations include a wide category of materials, both organic and inorganic. Commonly collected waste products include oil pails, sealant buckets, cardboard and paper products, cellophane, wood materials including pallets and waste timber products, banding materials, food products and many other items. Inorganic materials include, for example, plastic bottles, plastic sheet material, metal roof bolts and plates, mine ribbing materials, and mined debris, such as rock material.

Overall, the waste material, debris, and refuse that are removed from the mine are generated from the men and equipment for carrying out the mining operation. The refuse must be continually moved out of the mine to prevent its build up that can create a fire hazard. The conventional practice of collecting and transporting refuse out of the mine is a continual process that entails the collection and hauling by a number of methods available to mine personnel, typically by open top receptacles, such as conventional containers known as "dumpsters".

Once a dumpster is filled, it must be moved to a location where the refuse can be extracted from the mine. This occurs in multiple hauling operations. Dumpsters are heavy and immobile and require loading onto a mine utility vehicle for movement to an airshaft where the dumpster is hoisted out of the mine to the surface. In many cases, the contents of a dumpster are transferred by hand into a stationary compactor which is moved out of the mine to the surface. At the surface, the contents of the dumpster or stationary compactor are picked up by a commercial hauler or emptied into a surface compactor or a pre-crusher compactor to reduce the volume of trash before it is hauled from the mine site by the commercial hauler.

The movement of dumpsters through the ventilated passageways of a mine is cumbersome and expensive because it requires the use of men and machinery for transporting the dumpsters and removes these resources from the tasks that support the production of mined material. One practice to facilitate the removal of dumpsters filled with refuse from the mine has been to connect the dumpsters and haul them to a central site located at an airshaft with a hoist for extraction and compaction on the surface out of the mine. This operation creates congestion in the mine passageways, particularly where the passageways have only one lane for travel. Consequently, the utilization of men and material for carrying out the mining operation is disrupted by the transport of dumpsters filled with refuse out of the mine. In many cases, the dumpsters have open tops, and the movement of the dumpsters generates discharge of the waste from the receptacles. As a result, the mine passageway is littered with debris, further creating a fire hazard and requiring the mine operation to take additional measures to comply with state and federal safety regulations.

The use of open top dumpsters to haul refuse to a central location in the mine requires multiple trips, creating a greater demand for the services of a commercial hauler to pick up the refuse once it is moved out of the mine to the surface. This imposes upon the mine operator the expense of daily hauling fees for disposal of the refuse. A disposal fee must be paid by the mine operator for each dumpster or receptacle that is picked up by a commercial hauler for transport to a disposal site.

To eliminate the problems associated with bulk handling of refuse and waste material collected in open top receptacles in a mine, hydraulically operated compacting units have been proposed for compacting waste in receptacles in an underground mine to facilitate more convenient transport of the waste material in a compacted condition out of the mine. German Patent 42 40 286 discloses a stationary compactor unit that is positioned at a desired location in the underground mine. The waste material is brought to the compaction unit and deposited through a feed hopper into a compression chamber. In the compression chamber, the waste material is compacted into a bale, and the bale is tied or wrapped by banding. After banding, the bale is ejected from the compaction unit. The banded, compacted bale of waste material is then transported out of the mine.

Use of waste compaction units below ground in excavation pits are disclosed in U.S. Pat. Nos. 4,269,562 and 4,358,238. U.S. Pat. No. 4,358,238 discloses an excavated open pit for receiving a compactor having an open top having a vertically positioned tubular chute. A receptacle containing the refuse is moved into position by a truck over the chute. The refuse is deposited through the chute into the compactor positioned in the pit. U.S. Pat. No. 4,269,562 also discloses a refuse compactor that is positioned below ground level in a ditch or trench. The refuse from a delivery truck is deposited into the below ground compactor.

U.S. Pat. No. 4,144,806 discloses a hydraulically operated trash container unit that slides on transverse rods of a skid. When the trash container unit is full of compacted trash, turnbuckles are loosened to allow the unit to be lifted out of connection with the housing unit by hoist lines and lowered on to a dump vehicle for receiving the compacted trash from the container unit.

U.S. Pat. No. 7,597,045 discloses a hydraulically operated compactor mounted on a base assembly which is bolted or mounted to the floor of a mobile truck or trailer. The compacting apparatus is designed to minimize the height and length in comparison with conventional compacting apparatus. U.S. Pat. No. 6,550,378 also discloses a compacting waste apparatus having a low profile feature for reducing the vertical dimension of the apparatus.

U.S. Pat. No. 3,881,407 discloses a compactor for compacting and storing waste material including in combination a storage box and a portable packing mechanism which is movable into and out of position relative to the storage box. U.S. Pat. No. 7,980,173 discloses a self-contained portable compactor having a hydraulic fluid power supply equipped with a breakaway coupler that facilitates a quick connect/ disconnect of the hydraulic fluid lines to the compactor for a movement of the compactor.

There is need in underground mining operations for a system for disposing of waste material collected in the mining operations that allows for efficient collection and compaction of the waste material in the mine before it is removed from the mine. The number of hauls of uncompacted waste material needs to be eliminated and consolidated by compacting the waste material for a more efficient collection and removal from the mine, so as to reduce the expense of commercial waste hauler services. By efficiently collecting and disposing of waste material in a mine, the mining operation is not disrupted to accommodate waste haulage from the mine and the use of mine personnel for this function.

SUMMARY OF THE INVENTION

In accordance with the present invention there is provided a method for disposing of waste material in an underground mine that includes the steps of transporting a mobile compactor to selected locations for collecting waste material in an underground mine. The compactor is connected to a power supply for operation at a selected location. Waste material collected at the selected location is deposited into the compactor. The compactor is actuated from the power supply to compact the waste material. The compactor containing the compacted waste material is transported to a location in the mine for removal from the mine. The compacted waste material is removed from the mine.

Further, in accordance with the present invention there is provided a method for collecting and removing waste material from an underground mine that includes the steps of transporting a mobile compactor having a container for receiving waste material to a working section of an underground mine. The waste material collected at the working section is deposited into the container of the compactor. The waste material is compacted in the container at the working section. The container with the compacted waste material is separated from the compactor. The separated container with the compacted waste material is transported from the working section to a location for removal from the underground mine. The container with the compacted waste material is extracted out of the underground mine.

Additionally, in accordance with the present invention there is provided a system for disposing of refuse in an underground mine that includes a mobile compactor unit positioned at a selected location in the passageway of a working section of an underground mine for collection of refuse. The compactor unit is mounted on a mobile frame to facilitate movement of the compactor unit from a central location in the mine through the mine passageway to the selected location for collection of refuse. The compactor unit includes a compaction chamber for collection of refuse and a refuse receiver for containment of the compacted refuse. A power supply is accessible to the compactor unit at all locations in the mine. The power supply is operable to actuate the compaction of refuse and movement of the compacted refuse from the compaction chamber to the refuse receiver. A utility vehicle is removably connected to the compactor unit for moving the compactor unit through the mine passageway between the central location and the selected location in the mine for collection of refuse. The compactor unit containing the compacted refuse is moved by the utility vehicle to the central location where the compacted refuse is extracted from the mine for disposal out of the mine.

A principal object of the present invention is to provide method and apparatus for efficiently and economically collecting, handling, and removing refuse and waste material from an underground mine.

A further object of the present invention is to reduce the frequency over a period of time of individual hauling operations of refuse and waste material out of an underground mine.

Another object of the present invention is to reduce the cost to the mining operation of commercial haulage of waste material from the mine.

A further object of the present invention is to provide a system for moving mobile compactors to selected locations in an underground mine for collecting and compacting waste material and refuse that are generated as part of the mining operation and movement of the compacted waste material to a central location for transportation out of the mine so that the volume of waste material removed from the mine is reduced by compacting the material before it is transported out of the mine.

An additional object of the present invention is to provide a waste disposal system in an underground mine that permits the collection and compaction of waste material at any location in the mine, including the working face, so as to prevent the accumulation of waste material that presents a threat of fire.

A further object of the present invention is to provide for the transportation of mobile waste compacting units throughout an underground mine to progressively collect and compact waste so as to reduce the accumulation of waste' and reduce the haulage of uncompacted waste out of a mine.

These and other objects of the present invention will be more completely disclosed and described in the following specification, the accompanying drawings, and the appended claims.

DESCRIPTION OF THE PREFERRED EMBODIMENTS

Figure 6:
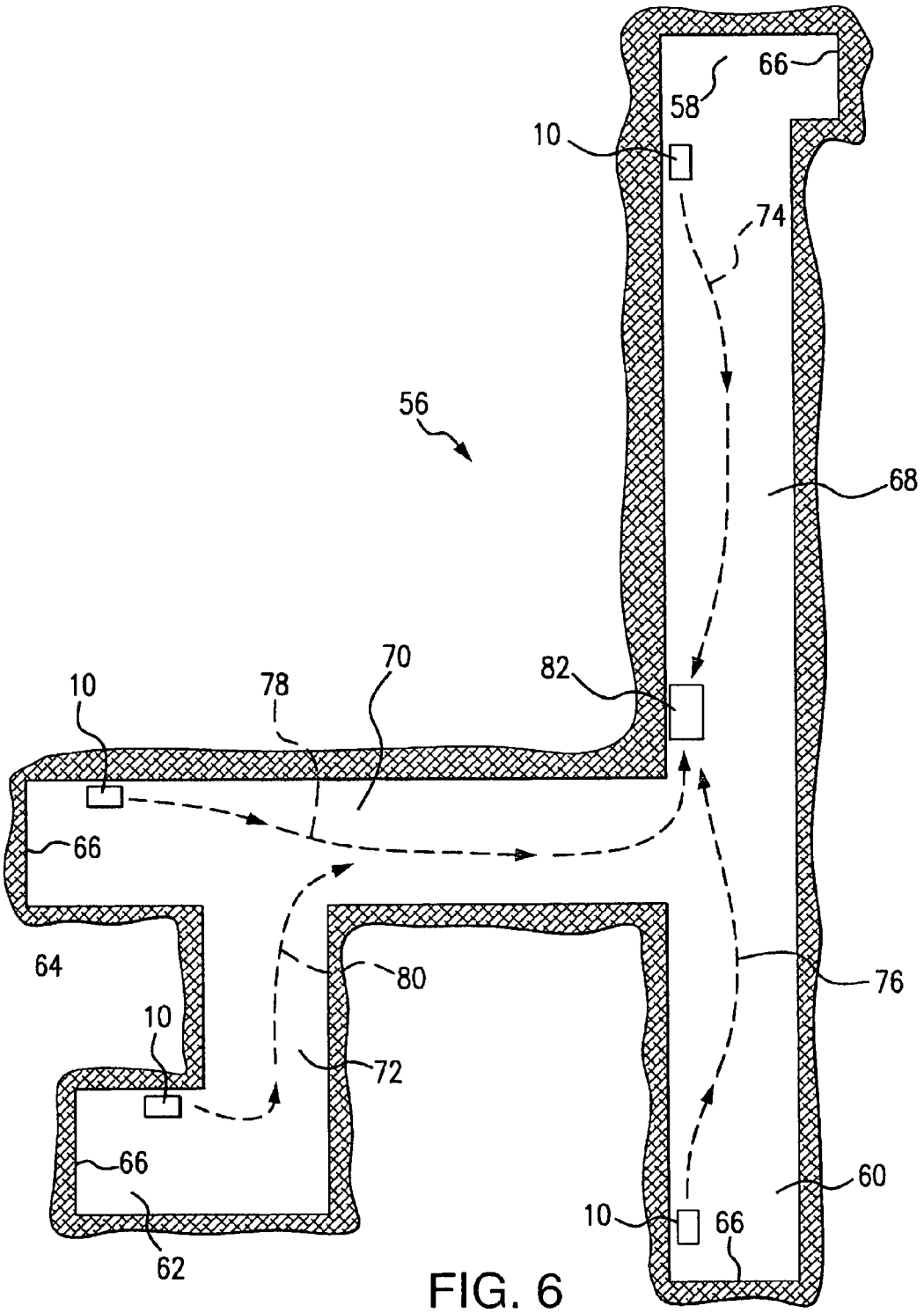
FIG. 6 is a schematic illustration of a method for locating and moving individual compactor units, as shown in FIGS. 1-4, from remote positions in a mine for collecting and compacting waste material for removal from the mine.
Figure 7:
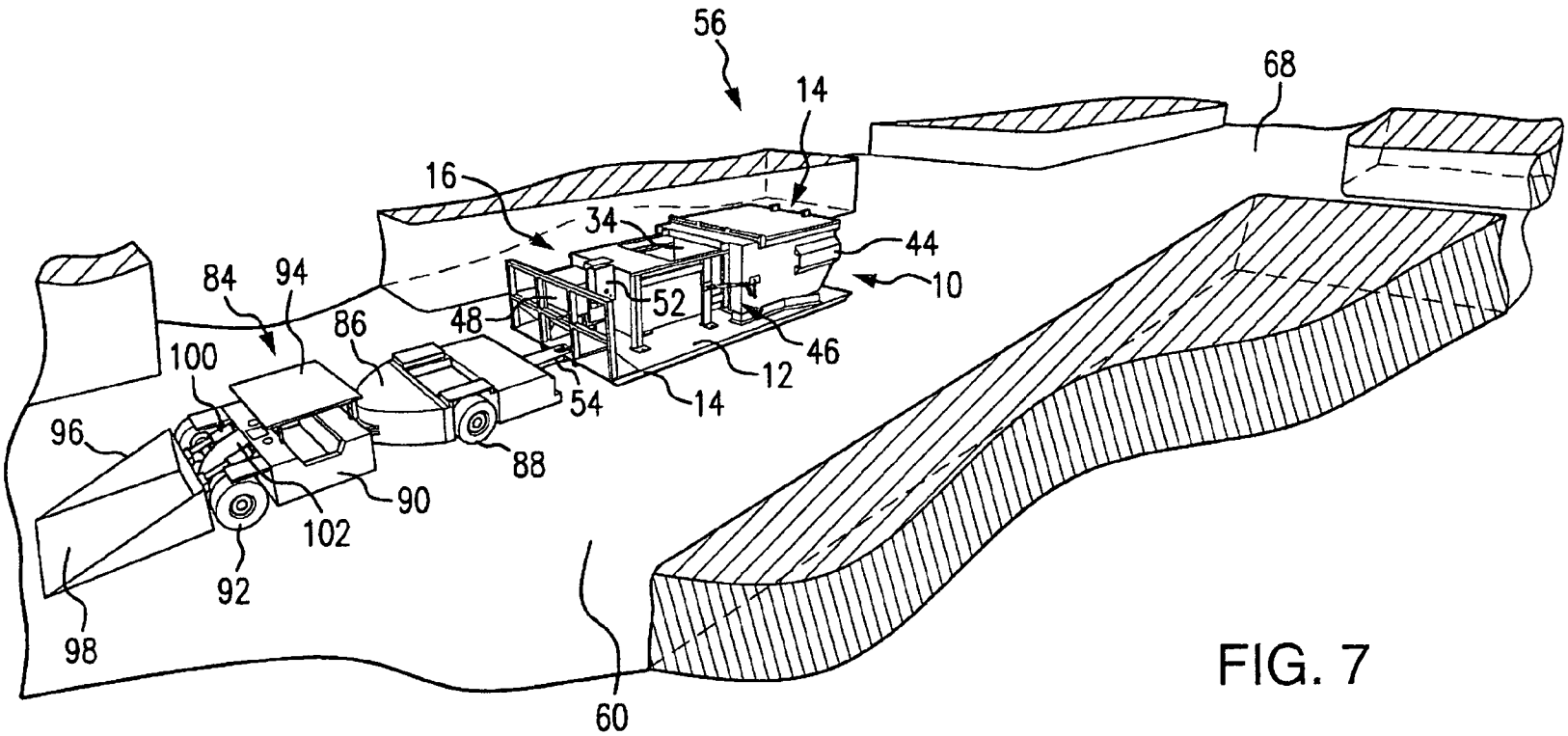
FIG. 7 is a fragmentary, cross-sectional isometric view of the mobile compactor unit shown in FIGS. 1-4 positioned in a passageway of an underground mine for the collection of waste material, illustrating a mine utility vehicle for moving the compactor unit in the passageway.

Referring to the drawings and particularly to FIGS. 1-4, there is illustrated a mobile compactor generally designated by the numeral 10 that is mounted on a frame 12 supported by a skid platform 14 for movement of the compactor 10 through the passageways of an underground mine, as shown in FIGS. 6 and 7, for the collection, compaction and removal of waste material and refuse from the underground mine. The mobile compactor 10 includes a hydraulically operated compaction device generally designated by the numeral 16 and a removable refuse receiver 18. The compaction device 16 is constructed of sidewalls 20, 22, 24, and 26 secured by frame members 28, 30, and 32 to the support frame 12. The sidewalls 20-26 and the frame members 28-32 form a compaction chamber 34 for receiving refuse, waste material, debris and the like for compaction. The vertical dimensions or height of the compaction device 16 and receiver 18 are selected to facilitate unobstructed movement of the compactor 10 in the mine having height restrictions.

The refuse receiver 18 is mounted on the support frame for removable attachment to the compaction device 16. The receiver 18 includes opposite sidewalls 36, an end wall 38, and a top wall 40 that is pivotally connected by a hinge 42 to the sidewalls 36. This permits the top wall 40 to be pivoted upwardly to an open position to allow the contents of the receiver 18 to be dumped by turning the receiver 18 upside down. In one method of operation to remove the receiver 18 from the support frame 12, lift forks (not shown) of a mine haulage vehicle or a dump truck engage the channel members 44 on the sidewalls 36 of the receiver 18 to lift the receiver and deposit the contents of the receiver into the dump truck. The receiver 18 can also be lifted onto the scoop portion of a mine utility vehicle, illustrated in FIG. 7, for transport in the mine.

Figure 1:
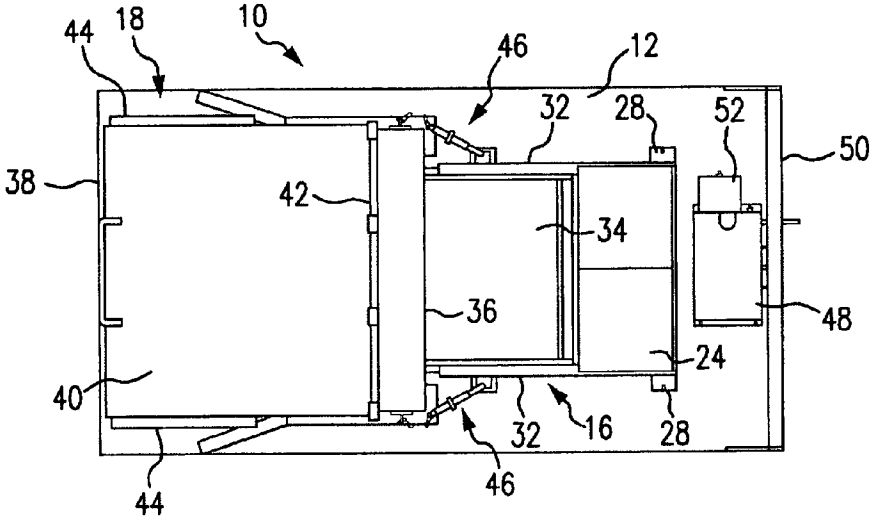
FIG. 1 is a top plan view of a mobile compactor for use in collecting and transporting compacted waste material from an underground mine, illustrating a trash receiver removably connected to a compaction chamber mounted on a skid platform.
Figure 2:
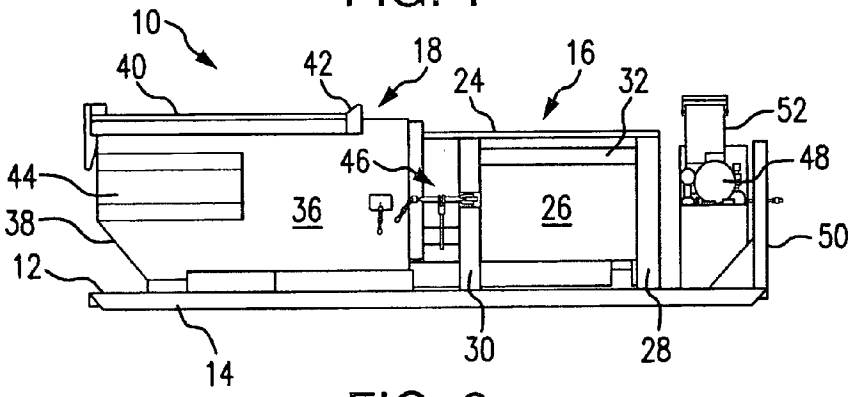
FIG. 2 is a view in side elevation of the mobile compactor shown in FIG. 1, illustrating the skid platform for moving the compactor through the passageways of an underground mine.
Figure 3:
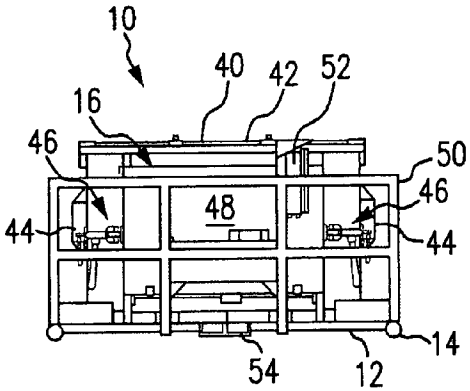
FIG. 3 is an end view of the mobile compactor shown in FIG. 2, illustrating the control panel for receiving electrical or hydraulic power for actuating the compactor.
Figure 4:
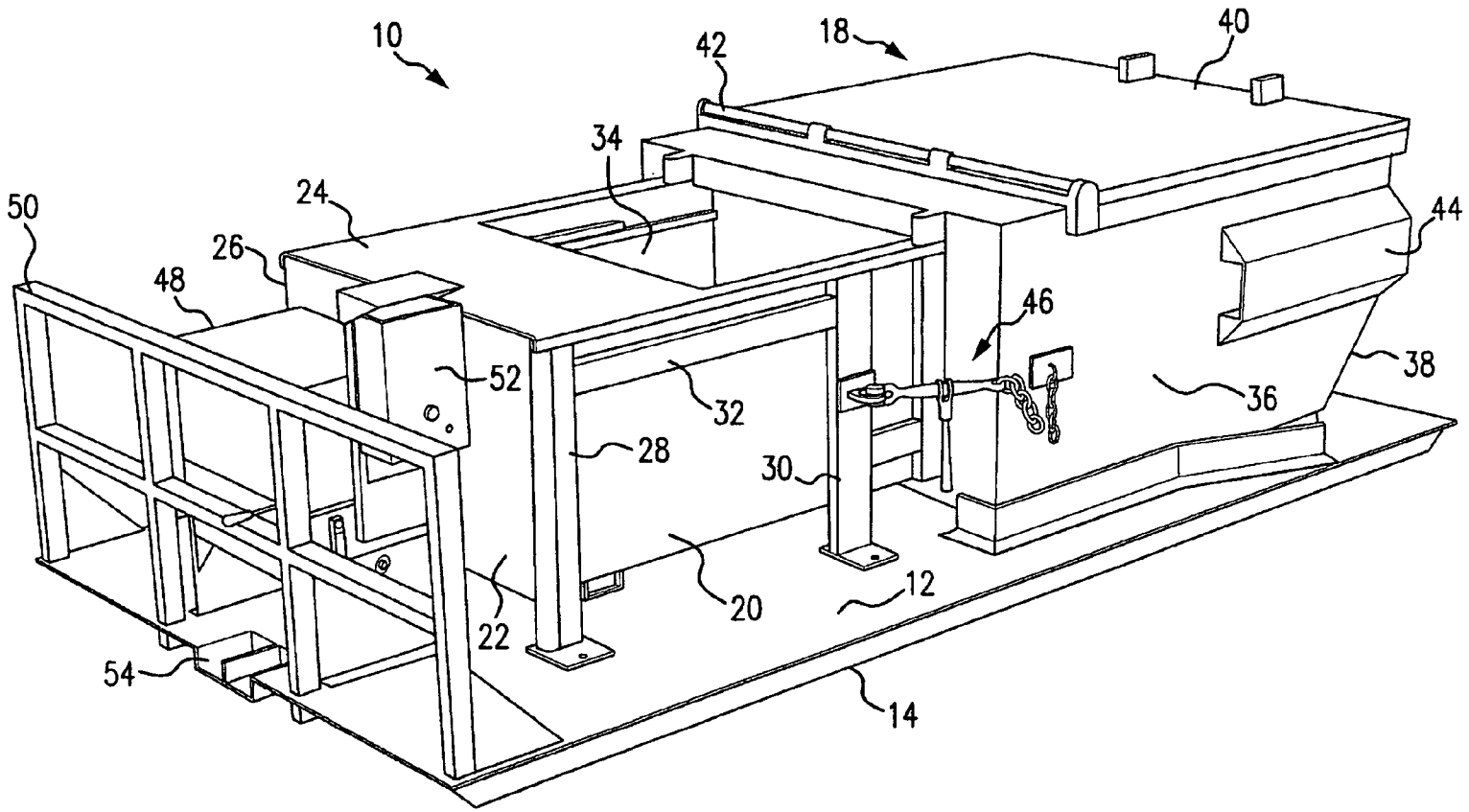
FIG. 4 is an isometric view of the mobile compactor as shown in FIGS. 1-3 for collecting, compacting, and removing waste material from an underground mine.

The refuse receiver 18 is removably connected to the compaction device 16 on the support frame 12 by the provision of a conventional turnbuckle mechanism generally designated by the numeral 46. As shown in FIG. 1, a turnbuckle mechanism 46 is connected at opposite ends to the receiver sidewall 36 and the frame member 30 for supporting the compaction device 16. As shown in FIGS. 1, 2, and 4, the turnbuckle locking mechanism 46 securely engages the receiver 18 to the compaction device 16 on the support frame 12. When the turnbuckle locking mechanism 46 is released, the receiver 18 may be removed from the support frame 12 and the mobile compactor 10 by engagement of forklifts from a haulage vehicle engaging the channel members 44 as above described.

The compaction chamber 34 of the compaction device 16 includes a hydraulically operated ram (not shown) having at one end a ram plate that moves from the compaction chamber 34 through an opening in the receiver 18 opposite the chamber 34. In one embodiment the hydraulic ram includes a pair of single stroke hydraulic cylinders (not shown) connected to a hydraulic pump (not shown). The hydraulic pump is actuated by an electric motor 48 supported by a frame 50 at the end of the support frame 12. The electric motor 48 is actuated by a switching mechanism, such as a dead man switch, contained in an operator panel 52. When the electric motor 48 is activated from the panel 52, the motor 48 operates the hydraulic pump which in turn operates the hydraulic cylinders to push the ram plate through the compaction chamber 34 into the refuse receiver 18. With the compaction chamber 34 filled with refuse and waste material, the ram plate advances the refuse into the receiver 18 where it is compressed or compacted to reduce the volume of the refuse.

With the refuse receiver 18 mounted on the skid platform 14, the mobile compactor. 10 is not limited to operation at the locations in the mine only where electric power is accessible but is also operable at remote locations where electric power is not available. In this manner, the compactor 10 can be moved from one location to another in an underground mine, as desired in the system of collecting and removing refuse from the mine.

The mobile compactor 10 is dragged on the floor of a mine passageway by connecting a cable or chain from a mine utility or haulage vehicle, shown in FIG. 7, to a lifting hook positioned on the end of the frame 12 adjacent to the electric motor 48. If it is desired not to move the entire mobile compactor 10 from a location of operation but to move only the refuse receiver 18, the turnbuckle locking mechanisms 46 are disengaged to allow the receiver 18 to be picked up and positioned on the platform or scoop portion of a mine utility vehicle. The compacted refuse is then transported in the receiver 18 to the desired location in the mine for extraction of the receiver 18 out of the mine. Once out of the mine on the surface, the compacted waste material is transferred from the receiver to a commercial hauler for disposal, such as at a landfill.

With the provision of the electric motor 48 on the support frame 12, the hydraulic pump actuates hydraulic cylinders that push the ram plate through the compaction chamber 34. Electrical power is supplied at the power center of the working section of the mine where the mobile compactor 10 is located. The operator panel 52 on the mobile compactor 10 is equipped for connection to a hydraulic power takeoff from any piece of mobile equipment in the mine, such as the mine utility vehicle shown in FIG. 7. With this arrangement, when the mobile compactor 10 is at a location in the mine which is remote from an electrical power supply, the compaction device 16 is operated by connection to the hydraulic power takeoff from the mine utility vehicle.

A quick connection of hydraulic lines is made from the mine utility vehicle to the hydraulic pump for actuating the hydraulic cylinders on the compactor 10. The benefit of this source of power supply to the mobile compactor 10 allows it to be moved to locations in the mine that would otherwise be inaccessible for the collection and compaction of refuse. Consequently, the accumulation of waste material and refuse is prevented in areas of the mine where electric power is not available and manual hauling of uncompacted refuse is required, for example, at the mine face.

As shown in FIGS. 6 and 7, the mobile compactor 10 of the present invention is used in a system for efficiently and economically collecting and removing waste material, refuse, debris and the like from the working sections of an underground mine. As schematically illustrated in FIG. 6, an underground mine 56 includes a plurality of working sections 58, 60, 62, and 64 where each section advances to a working face 66 from which mine material is dislodged and transported from the respective working sections 58-64 through the connecting passageways 68, 70, and 72. It should be understood that the underground mine 56, shown in FIG. 6, is only a portion of a total underground mining operation.

At the respective working sections 58-64, a wide variety of waste material, refuse, and debris is generated during the mining operation. The refuse must be continuously removed from the working section in compliance with health and safety regulations and principally to eliminate fire hazards.

As shown in FIG. 6, a number of mobile compactors 10 are located at preselected locations in the working sections 58-64, for example near the mine face 66 where the mining activity is concentrated. The waste material collected at the mine face is deposited into the compaction chamber 34 of the compaction device 16. The electric motor 48 on the compactor 10 is connected in a conventional manner to the electric power center located in the working section. Once the trash, debris, and waste material have been collected from the section and deposited into the compaction chamber 34, the hydraulic pump on the compactor 10 is actuated by switching on the electric motor 48. The compaction device 16 compacts the material in the receiver 18.

Figure 5:
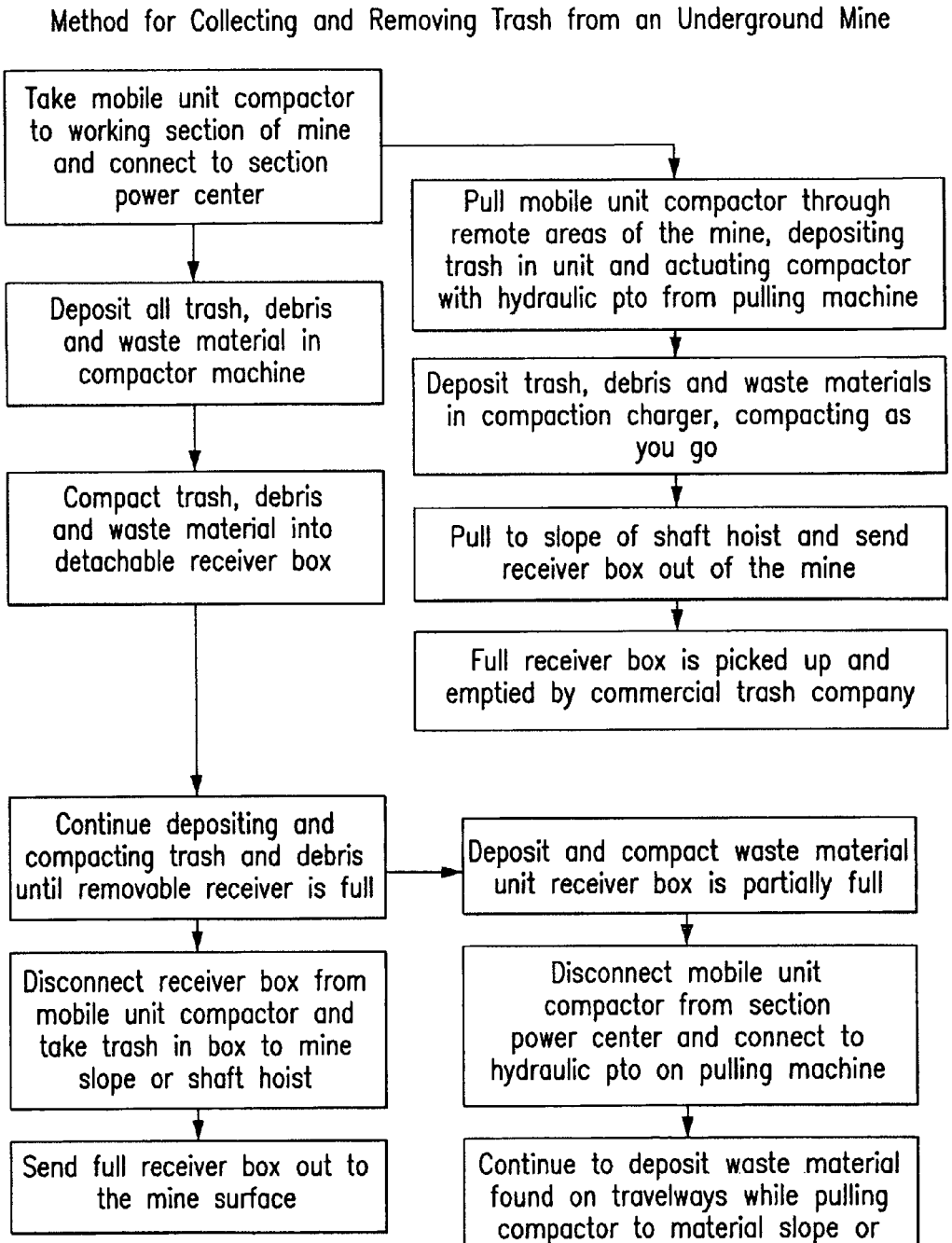
FIG. 5 is a flow diagram, illustrating methods for collecting and removing waste material from an underground mine by the mobile compactor shown in FIGS. 1-4.

As diagrammatically illustrated in FIG. 5, in one method of operation, the waste material is continued to be deposited and compacted in the mobile compactor 10 until the receiver 18 is full. At this point, the compacting operation is terminated, and the receiver 18 is removed from connection to the compaction device 16. The receiver 18 is transferred from the support frame 12 to a mine utility vehicle. The mine utility vehicle hauls or drags the receiver 18 from the respective working sections in the direction indicated by the arrows 74, 76, 78, and 80 to a central location 82 where the compacted refuse is collected and transported out of the mine up the mine slope or hoisted through a shaft to the surface.

An example of a conventional mine utility vehicle suitable for use with the present invention is generally designated by the numeral 84 in FIG. 7. The vehicle 84 includes a drive or traction unit 86 mounted on wheels 88. The traction unit 86 is coupled to an operator's compartment 90 supported by wheels 92 and having an overhead protective canopy 94 to protect the operator from dislodged mined material. The operator's compartment 90 is connected to a scoop or bucket 96. The scoop 96 has a material receiving compartment 98. The scoop is controlled by the operator for preselected movements in raising, lowering, advancing, and retracting the scoop 96 to load up dislodged mined material on the mine floor for containment in the compartment 98 and unload the contained material and to perform other material haulage operations in the mine. The movement of the scoop 96 is controlled by hydraulic piston cylinder assemblies 100, one of which is shown in FIG. 7.

With the present invention, the mine utility vehicle 84 in one method of operation is releasably connected at the end of drive unit 86 to the lifting hooks 54 on the end of the mobile compactor 10 to drag the skid platform 14 of the compactor 10 through the mine passageways 68-72. In another method of operation, the refuse receiver 18 is disconnected from the compaction device 16, lifted from the support frame 12, and loaded into the scoop compartment 98 to transport the receiver containing compacted waste material to the central location 82, shown in FIG. 6, for removal of the compacted waste material from the mine.

Positioned forward by the operator's compartment 90 and behind the scoop 96 on the utility vehicle 84 is a conventional hydraulic power takeoff 102 from which hydraulic power through conventional hydraulic lines (not shown) is supplied to the hydraulic pump of the compaction device 16 on the compactor 10. In this manner, the compaction device 16 and receiver 18 are operated in areas of the mine where electric power is not available to power the electric motor 48. This enables compaction of waste material by the mobile compactor 10 in all areas of the mine where the compactor 10 is located.

Thus in operation, when the compactor 10 leaves the power center of a working section, it is moved to locations in the mine where electric power is not accessible. The compactor continues to operate in the remote locations by connecting the hydraulic pump to the hydraulic power takeoff on the mine utility vehicle 84 that is pulling the compactor 10 through the mine passageway. At these remote locations waste material and debris are deposited in the compaction chamber 34 and compacted in the receiver 18. The compactor 10 is pulled from one location to another for pick-up and compaction of waste material collected throughout the mine passageways, until the receiver 18 is full. At this point, the compactor 10 is pulled to the central location 82 for removal of the compacted waste material from the mine.

The compacted contents of each receiver 18 are transferred at the central location 82 to a larger compactor where the compacted waste material is consolidated for further compaction before it is transported out of the mine. When the larger container is filled it can be hoisted or removed from the mine. Alternatively, each receiver 18 when advanced to the central location 82 is moved from the underground mine to the mine surface. At the mine surface, the compacted material is then collected by a commercial hauler for disposal at a landfill or by other desired operations.

Another method of collecting and disposing of waste materials in an underground mine is described in FIG. 5. After waste material and debris are collected in an area adjacent to a mine face 66, the mobile compactor 10 is disconnected from the power center at the respective working sections 58-64 and advanced by the mine utility vehicle 84, shown in FIG. 7, from the position illustrated in FIG. 6 in the direction of the arrows 74-80 to the central location 82. The compactor 10 is advanced in the respective mine passageways 68-72 by hitching the compactor 10 at the lifting hook 54 to the mine utility vehicle 84.

The mine utility vehicle 84 in one method pulls the compactor 10 to slide the skid platform 14 on the mine floor. In this manner, the compactor 10 is dragged from its initial fixed position in a mine working section to the prescribed central location 82. As the compactor 10 is dragged through the mine passageways, waste material, debris and refuse are collected and deposited into the compaction chamber 34 and compacted in the receiver 18.

Where the compacting operation is performed in areas of the mine where there is no access to electric power, the hydraulic pump on the compactor 10 is connected to the hydraulic power takeoff that is provided on the mine utility vehicle 84 that drags the compactor 10 in the mine passageways. In this manner, the compaction of the waste material deposited in the compaction device 16 is accomplished without the need for access to electric power. Also, once the compactor 10 is disconnected from the power center in the working section, it continues to operate to compact the waste material as the compactor is moved through the mine passageways to the central collection point 82.

As shown in FIG. 6, each of the compactor units 10 positioned in the passageways 68-72 is moved from the working face 66 at the respective working sections 58-64 to the location in the directions indicated by the arrows 74-80. Waste material is collected as the compactor is moved. As each compactor 10 moves through the mine passageways, waste material is continually deposited and compacted on the mobile compactor by the provision of connecting the hydraulic pump to the hydraulic power source provided on the mine utility vehicle 84 that drags the compactor 10. In this manner waste material, debris and the like that accumulates in remote sections of the mine is collected for removal from the mine.

Once the compactors 10 have completed the travel from the respective working sections 58-64 to the central location 82, the compacted waste material from the receiver 18 on each compactor 10 is deposited in one method into a stationary receiver for collecting the compacted waste material from the individual receivers 18. The collected compacted waste material is further compacted and then moved out of the mine via the mine slope or hoisted through a shaft to the mine surface.

In another method of operation of the present invention, once each compactor 10 reaches the central location 82, the receiver 18 is disconnected, in the manner as above described, from the compaction device 16. The separated receiver 18 is moved out of the mine through the mine slope or hoisted through a mine shaft to the mine surface. Once out of the mine on the surface, the receiver 18 filled with compacted waste material is then transferred to a commercial waste hauler for final disposal or to a surface compactor or a pre-crusher compactor.

It should also be understood as an alternative to moving the mobile compactor 10 by hitching it to the mine utility vehicle 84 and dragging it on the mine floor, the receiver 18 is disconnected from the compactor device 16. In one method, the receiver 18 is loaded into the compartment 98 of the utility vehicle scoop 96 for transportation to the central location 82 in the mine where the receiver 18 is extracted out of the mine to the surface. Once the receiver 18 with compacted waste is transported to the surface, the compacted waste material is then deposited into an open top container or into a surface compactor which then further compacts the waste material for reducing its volume for hauling from the mine site. In this manner, the number of commercial hauls and the expense associated therewith are reduced.

With the present invention of collecting and compacting waste material, debris and refuse from a mine, multiple hauls of uncompacted waste material out of the mine are eliminated. This also reduces the frequency of contracted services of a commercial waste hauler. The intervals of pick-up of waste material from the mine by the commercial waste hauler are reduced. The pick-up can be based on an "on-call" basis where the pick-up occurs only when needed and does not have to be performed on a daily basis. These benefits of the present invention allow the mine operator to negotiate more competitive commercial hauling contracts whereby waste material is removed only as needed and in a timely manner, further assuring compliance with mine safety standards.

According to the provisions of the patent statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. A method for disposing of waste material in an underground mine comprising the steps of, transporting a mobile compactor throughout an underground mine from one location in the mine to another location for collecting waste material, connecting the compactor to a power supply for operation at selected locations in the underground mine, depositing waste material collected at the selected locations into the compactor, actuating the compactor from the power supply to compact the waste material, transporting the compactor containing compacted waste material from one location to another location in the underground mine for removal from the mine, and removing the compacted waste material from the mine.

2. A method as set forth in claim 1 which includes, moving the mobile compactor from one location to another in the underground mine to receive waste material, and compacting the waste material at the location of pick-up to prevent the accumulation of waste material in the mine.

3. A method as set forth in claim 1 which includes, supplying electric power to the compactor at a working section in the mine for compacting the waste material, and supplying hydraulic power to the compactor for compacting the waste material when electric power is not available to activate the compactor at a selected location in the mine.

4. A method as set forth in claim 1 which includes, transporting the mobile compactor from one location to another in the mine for collecting and compacting waste material by pulling the compactor through the passageways of the mine.

5. A method as set forth in claim 1 which includes, pulling the compactor through the passageways of the mine by a mine utility vehicle sliding the compactor on the mine floor, collecting waste material as the compactor is pulled from one location to another through the mine passageway, and supplying power from the mine utility vehicle to the compactor as the waste material is collected to actuate the compactor to compact the waste material.

6. A method as set forth in claim 1 which includes, depositing the waste material in a compaction chamber of the compactor, removably connecting a receiver for containment of the waste material on the compactor to the compaction chamber, compacting in the receiver the waste material received from the compaction chamber, removing the receiver containing the compacted waste material from connection to the compaction chamber, and transporting the receiver out of the mine for disposal of the waste material compacted in the receiver.

7. A method as set forth in claim 6 which includes, removably connecting the receiver to the compaction chamber on a mobile frame, pulling the mobile frame by a mine utility vehicle to the selected locations in the mine for collecting and depositing waste material in the compaction chamber, powering the compaction chamber to compact the waste material in the receiver by selecting one of electric power and hydraulic power available in the mine, removing the receiver containing compacted waste material from connection to the compaction chamber on the mobile frame, and transferring the receiver from the mobile frame to the mine utility vehicle for transporting the receiver to a location for removal of the receiver containing the compacted waste material from the mine.

8. A method as set forth in claim 1 which includes, supplying electrical power to the compactor for compacting waste material collected on the compactor, and switching the power supply to a hydraulic power source for activating the compactor when electrical power is not available at a location in the mine to compact the collected waste material.

9. A method as set forth in claim 1 which includes, continuing to deposit waste material into the compactor with hydraulic power being supplied to compact the waste material as the compactor moves through the mine.

10. A method for collecting and removing waste material from an underground mine comprising the steps of, transporting a mobile compactor having a container for receiving waste material to a plurality of working sections of an underground mine, depositing waste material collected at each working section into the container of the compactor as the container is transported throughout the underground mine, compacting the waste material in the container at each working section, separating the container with the compacted waste material from the compactor, transporting the separated container with the compacted waste material collected from the working sections to a location for removal from the underground mine, and extracting the container with the compacted waste material out of the underground mine.

11. A method as set forth in claim 10 which includes, supporting the mobile compactor on a skid platform, positioning the skid platform on the floor of the underground mine, and pulling the mobile compactor to a selected working section in the mine as the skid platform slides on the mine floor.

12. A method as set forth in claim 11 which includes, attaching the skid platform to a mine utility vehicle, and moving the mine utility vehicle to drag the skid platform to a selected working section of the underground mine for compaction of the waste material collected at the working section.

13. A method as set forth in claim 12 which includes, providing on the mine utility vehicle a source of hydraulic power, connecting the compactor to the hydraulic power source, and actuating the compactor from the hydraulic power source to compact the waste material collected at the selected working section in the mine.

14. A method as set forth in claim 10 which includes, transferring the separated container with the compacted waste material to a mine utility vehicle, moving the mine utility vehicle to a selected location in the mine, removing the separated container from the mine utility vehicle, and transporting the separated container out of the mine for disposal of the compacted waste material.

15. A method as set forth in claim 10 which includes, connecting the compactor to an electric power supply for actuating the compactor to compact waste materials collected at a selected location in the underground mine.

* * * * *